US008056884B2

(12) United States Patent
LaFreniere

(10) Patent No.: US 8,056,884 B2
(45) Date of Patent: Nov. 15, 2011

(54) CORDLESS HOIST

(76) Inventor: Randy A. LaFreniere, Panora, IA (US)

( * ) Notice: Subject to any disclaimer, the term of this patent is extended or adjusted under 35 U.S.C. 154(b) by 13 days.

(21) Appl. No.: 12/842,085

(22) Filed: Jul. 23, 2010

(65) Prior Publication Data

US 2010/0283020 A1 Nov. 11, 2010

Related U.S. Application Data

(63) Continuation of application No. 12/024,227, filed on Feb. 1, 2008, now Pat. No. 7,784,768.

(60) Provisional application No. 60/887,665, filed on Feb. 1, 2007.

(51) Int. Cl.
*B66D 5/32* (2006.01)

(52) U.S. Cl. ..... 254/376; 254/364; 254/323; 410/103

(58) Field of Classification Search ..... 254/313, 254/364, 376, 243, 323; 410/103
See application file for complete search history.

(56) References Cited

U.S. PATENT DOCUMENTS

| | | | | |
|---|---|---|---|---|
| 1,468,916 | A * | 9/1923 | Newhall et al. | 254/343 |
| 3,467,359 | A * | 9/1969 | Durand | 254/340 |
| 3,807,697 | A * | 4/1974 | Cotreau et al. | 254/276 |
| 3,994,476 | A * | 11/1976 | van Gennep | 254/272 |
| 4,151,981 | A * | 5/1979 | Gennep | 254/336 |
| 4,239,443 | A * | 12/1980 | Rysewyk | 414/618 |
| 5,217,208 | A | 6/1993 | Stephenson | |
| 5,522,582 | A * | 6/1996 | Dilks | 254/323 |
| 5,607,143 | A | 3/1997 | Regal | |
| 5,663,541 | A * | 9/1997 | McGregor, II | 200/17 R |
| 6,179,270 | B1 | 1/2001 | Higdon | |
| 6,371,449 | B1 * | 4/2002 | Chamberlain | 254/387 |
| 6,386,513 | B1 | 5/2002 | Kazerooni | |
| 6,386,514 | B1 * | 5/2002 | Ray | 254/323 |
| 6,467,755 | B2 | 10/2002 | Reilly et al. | |
| 6,494,435 | B1 | 12/2002 | Cauchon | |
| 6,682,050 | B1 * | 1/2004 | Ray | 254/134.3 R |
| 6,705,597 | B1 | 3/2004 | Reilly et al. | |
| 7,216,849 | B2 * | 5/2007 | Tremblay | 254/220 |
| 7,431,268 | B2 | 10/2008 | Steiner et al. | |
| 7,644,906 | B2 * | 1/2010 | Rodrigue | 254/242 |
| 2002/0195594 | A1 | 12/2002 | Cauchon | |
| 2007/0181729 | A1 | 8/2007 | Schuster | |
| 2008/0023681 | A1 * | 1/2008 | Cunningham | 254/362 |
| 2008/0061276 | A1 * | 3/2008 | Averill et al. | 254/323 |
| 2008/0185563 | A1 * | 8/2008 | Dueck | 254/266 |
| 2008/0224110 | A1 * | 9/2008 | Starks et al. | 254/264 |

* cited by examiner

*Primary Examiner* — Emmanuel M Marcelo

(57) ABSTRACT

A portable hoist assembly having a housing. The housing has a recoil spring secured thereto wherein the recoil spring is secured to a cable spool such that constant tension is provided on the cable spool. The cable spool contains a cable that is secured thereto and has a hook member secured at a first end. An actuating member having a self contained power source and connected to the cable is thus operable to feed and retract the cable.

15 Claims, 2 Drawing Sheets

CORDLESS HOIST

CROSS REFERENCE TO RELATED APPLICATION

This application is a continuation of U.S. Ser. No. 12/024,227 filed Feb. 1, 2008, which is a continuation of U.S. Ser. No. 60/887,665 filed Feb. 1, 2007.

BACKGROUND OF THE INVENTION

This invention relates to a hoist. More specifically, this invention relates to a cordless portable hoist.

Presented is a hoist for the general purpose of safely lifting or elevating handicapped, elderly, or any other person into a tree for the purpose of hunting. Currently, the only way to get into a tree for this purpose is to climb, use a ladder stand, or use a climbing tree stand.

The requirements or criteria to achieve this task were as follows: There is a need for something that is powerful enough to lift a human weighing approximately two hundred and fifty pounds with a safety factor of times three, (750 lbs), while seated in a tree stand (Hunting perch/apparatus). There is also a need to be able to operate in remote locations where a fixed power supply was not available or feasible. Other desired characteristics include a hoist that is lightweight, durable weather proof, compact, portable and has an onboard, self-contained, rechargeable power source.

Other needs include a power source preferably a battery capable of using either 120 vac or 12 vdc power chargers. Which would allow charging in remote locations from the cigarette lighter of a vehicle if necessary. Also a self-contained continuous wire feed (Constant tension) spool of wire rope or cable at least fifty foot in length is desired. Another need in the art is for auto-braking capability when powered down for safety. Additionally, an easy, simple, remote hand controls such as a pendant control to operate the lift up or down, in or out is desired. Further, limit switches to cut power in the full up & down positions for safety are needed.

Additional needs include a gearbox that could be operated mechanically without power in the event of power loss for safety. Also, the ability to be affixed to a structure that would support more than the weight being lifted via a hook at one end and the other affixed to an adjustable/leveling harness that could then be attached to the load to be lifted. Therefore a universal harness assembly or accessory would be needed. Another need is a cable end to be hooked over a branch or to a supporting structure would need to be attached from ground level so as not to defeat the purpose. Therefore the hook needs to be modified to accept an extension pole for this purpose. The pole itself would then be utilized as a stability tool to prevent or limit spinning if used as a hunter's lift.

All of the above criteria pertaining to the hoist used as a lifting device for the purpose of raising a hunter needed to be met and adequately and contained inside of a portable enclosure or housing. This is to protect the person from moving parts, the environment and debris from getting into the apparatus, as well as be the means to position or mount the components in a manner to achieve functionality and self-containment.

Thus, a primary purpose of the present invention is to provide a portable hoist.

Yet another object of the present invention is to provide apparatus and method for allowing disabled hunters to get into a tree stand.

These and other objects, features, or advantages of the present invention will become apparent from the specification and claims.

BRIEF SUMMARY OF THE INVENTION

A portable hoist assembly. The portable hoist assembly has a housing that is secured to a recoil spring such that a constant pressure is provided on a cable spool that is connected to the recoil spring. A cable is disposed about and wrapped around the cable spool and a hook member is secured to the end of the cable. An actuating member having a self contained power source is connected to the cable via a gear box to retrieve and retract the cable accordingly.

DETAILED DESCRIPTION OF THE PREFERRED EMBODIMENT

Figure 1:
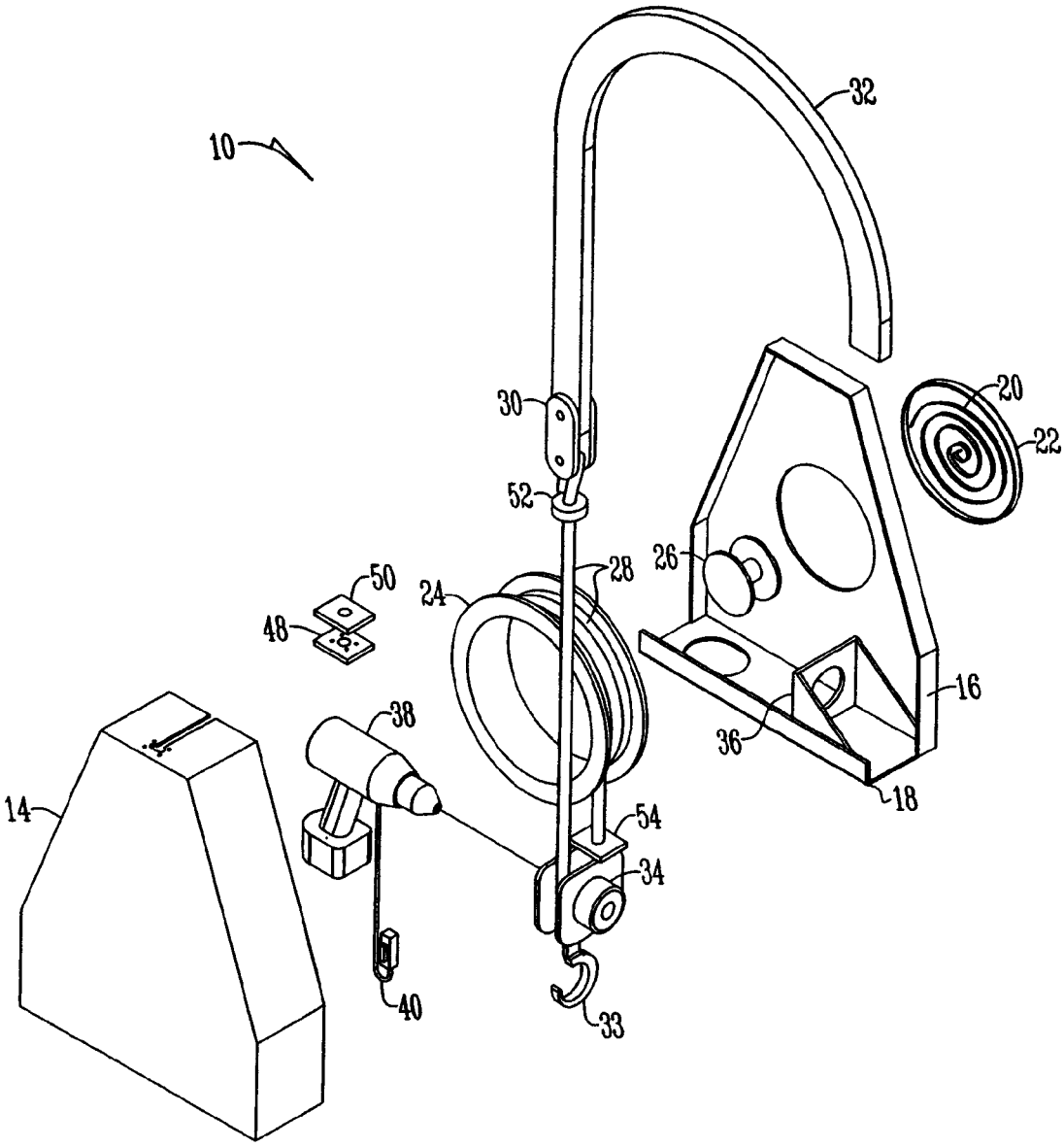
FIG. 1 is a exploded perspective view of a portable hoist assembly.
Figure 2:
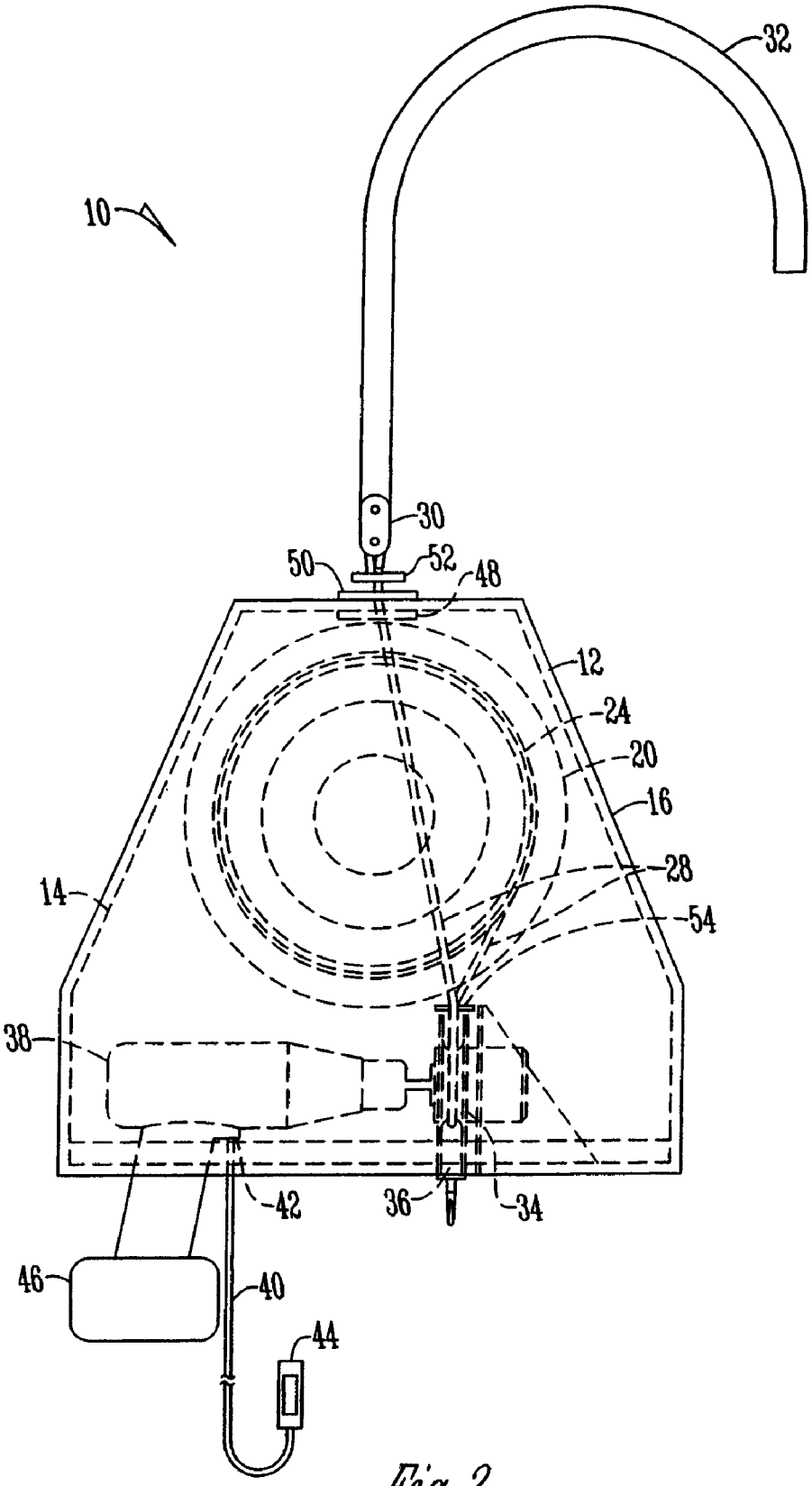
FIG. 2 is a side sectional view of a portable hoist assembly.

The figures show a portable hoist assembly 10. The portable hoist assembly 10 has a housing 12 that is comprised of an outer cover 14 and a frame 16 that enclose the components of the hoist assembly 10. A hinge hingedly connects the outer cover 14 and frame 16 together such that the cover 14 is able to retract away from the frame 16 to allow access to an interior of the housing 12.

Mounted within the frame 16 is a recoil spring 20 and recoil spring housing 22 that are secured to the frame 16. In a preferred embodiment the recoil spring 20 and housing 22 are bolted to the frame 16. A cable spool 24 is rotatably connected to the recoil spring 20 via a hub 26 that ties the spring 20 and cable spool 24 together. Thus, because the recoil spring 20 is secured to the frame 16 a constant tension is provided on the cable spool 24.

Cable spool 24 has a cable 28 disposed about and wrapped around the cable spool 24 in order to store the cable 28. A cable bracket 30 attaches the cable 28 to a first hook member 32. At the other end of the cable 28 the cable 28 has a second hook member 33 affixed thereto that is disposed out the bottom of the housing 12.

The hook first member 32 in one embodiment is considered a limb hook. Specifically, the hook member 32 can be positioned over a limb to a structure or to a load depending on the application. Specifically, the portable hoist assembly may be used 180 degrees or flipped to retract the cable 28 or the hook member 32.

The second hook member 33 in one embodiment is considered a stationary hook. The second hook member 33 is attached to a winch 34 which in one embodiment may be attached to a structure or the load being lifted or pulled depending on the application. The second hook member 33 may also be used at 180 degrees or flipped to retract the cable 28 or the first hook member 32. The winch 34 is mounted onto a winch mount 36 that is mounted to the housing 12. Further, the winch 34 or gear box is connected to the cable 28 to feed or retract the cable 28.

An actuating member 38 is disposed within the housing and is attached to the winch 34 to drive the winch in either direction. In a preferred embodiment the actuating member 38 is a cordless drill or motor that is rotatably connected to the winch 34 or gear box and drives the winch 34 in either direction.

A control tether 40 is electrically connected to a control switch 42 of the actuating member 38 at a first end and to a two position control switch 44 at a second end. In a preferred embodiment the tether 40 is a power cable. The two position control switch 44 or pendant hand control opens a circuit supplying power to the actuating member 38. In a preferred embodiment the two position control switch 44 opens a circuit supplying power from a battery 46 of the actuating member 38.

A split cable bushing 48 is additionally provided and attached to the outer cover 14 of the housing 12 to allow a smooth friction resistant guide for the cable 28. Additionally attached to the cover 14 of housing 12 is an upper limit switch 50 that is electrically connected to the actuating member 38 deactivates power to the actuating member 38 when tripped by limit trip 52 that is affixed to the first end of the cable 28. Similarly, a lower limit switch 54 is affixed to the second end of the cable 28 and electrically connected to the actuating member 38 such that when tripped by the limit trip 52, again power to the actuating member 38, is deactivated.

In operation the following components are assembled into the enclosure or housing 12 in a manner that requires a compact, lightweight, functional tool. Like other cordless tools, a rechargeable battery 46 supplies DC power to either a drill, motor or other actuating member 38 that drives a gear reducer or winch 34 in either direction via a hand held pendant controller 44. When power is applied to the drill, motor or actuating member 38 via the pendant controller 44, the actuating member 38 then drives the gear reducer/hoist 34. This hoist 34 then feeds or retracts an onboard cable 28 that is stored or spooled on a constant tension reel, paying out or retracting the cable 28. Both the gearbox 34 and actuating member 38 are equipped with power down braking.

One end of this apparatus is connected to any object strong enough to support the weight of that desired to hoist or pull. The other end is tied to the matter to be hoisted or pulled. When the power is applied by activating the hand held pendant 44 the item is then raised, lowered, or pulled. Limit switches 50 and 54 are also used to cut power to the actuating member 38 in the full up/down position to eliminate damage to the assembly 10.

Additionally, this hoist assembly 10 is operated and functions similar to other hoists/winches. However it utilizes a portable re-chargeable battery 46 as a source of power, unlike its counterparts, which are powered by a fixed power source, limiting their portability as well as versatility.

Basically everyone knows how hoists are utilized. They are utilized for the purpose of raising and lowering loads that are too heavy to manually or physically lift. This hoist assembly 10 was originally developed for the purpose of lifting a hunter and his tree stand into a tree; however it is so versatile that it was found to be useful in many other ways like lifting boats, or lifting ATV's into trucks, pulling motors, winching stuck vehicles, or pulling out dents. It could be used as a come along.

The hoist assembly 10 or lifting device serves many purposes. It can be used for applications similar to any other pre-existing hoist; however it is unique in the fact that it was designed to be cordless. It has an onboard power source in the form of a rechargeable battery 46. This allows it to be the ideal tool to be used in remote areas where there are no power sources available.

This rechargeable feature along with its onboard constant tension cable spool 24, compact size, and light weight, make it the ultimate portable hoist to perform unique tasks as well in remote areas where a fixed power supply may not be available. This hoist assembly 10 could be used as a winch as well. It could be stored in the trunk of an auto and used as a winch simply by attaching one end to the vehicle, the other to a stable fixed object then retracting or pulling to free the vehicle. It could be used to lift or raise game or other carcasses as well by simply tying one end to the game and the other through a pulley on the hook then to the base of the tree itself.

Thus, provided is a hoist assembly 10 that is both versatile and contains an independent power supply. Additionally, the hoist assembly 10 is portable, has a rechargeable power supply, is light weight, compact and has multiple uses and functions. Finally, provided is a hoist assembly 10 that provides a powerful lifting/pulling tool. As a result, at the very least all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A portable hoist assembly comprising:
- a housing having a frame;
- an outer cover connected to the frame;
- a cable spool rotatably connected to the frame;
- a cable, at least partially positioned around the cable spool;
- a first hook member connected to an end of the cable;
- a gear reducer connected to the frame;
- a motor connected to the gear reducer which rotates the gear reducer when activated;
- a battery connected to the motor;
- an activation switch connected to the portable hoist by a power cable; and
- a second hook member connected to the frame.

2. The portable hoist assembly of claim 1 wherein when the motor is activated the gear reducer is rotated.

3. The portable hoist assembly of claim 1 wherein when the motor is activated the cable spool is rotated.

4. The portable hoist assembly of claim 1 wherein when the motor is activated the cable is wound around the cable spool.

5. The portable hoist assembly of claim 1 wherein when the motor is activated it drives the gear reducer in either forward or reverse directions.

6. The portable hoist assembly of claim 1 further comprising a limit switch connected to the portable hoist that when actuated cuts power to the motor.

7. The portable hoist assembly of claim 1 further comprising a bushing connected to the housing that provides a low friction surface for the cable.

8. The portable hoist assembly of claim 1 wherein the gear reducer is connected to the cable spool by the cable.

9. The portable hoist assembly of claim 1 wherein the housing has first and second sections which connect together to form the housing.

10. A portable hoist assembly comprising:
- a housing having a frame;
- a cable spool positioned within the housing and rotatably connected to the frame;
- a gear reducer positioned within the housing and rotatably connected to the frame;
- a motor positioned within the housing and connected frame;
- a power source positioned within the housing and connected to the frame;
- an activation switch connected to the motor, such that when activated the gear reducer is rotated.

11. The portable hoist assembly of claim 10 further comprising a cable connected to the cable spool.

12. The portable hoist assembly of claim 10 further comprising a first hook member connected to an end of the cable.

13. The portable hoist assembly of claim 10 wherein a second hook member connected to the frame.

14. A portable hoist assembly comprising:

a housing having a frame;

a gear reducer positioned within the housing and connected to the frame;

a cable spool positioned within the housing and connected to the frame;

an actuating member positioned within the housing and connected to the gear reducer;

a power source positioned within the housing and electrically connected to the actuating member;

an activation switch connected to the actuating member;

a cable connected to the gear reducer and extending at least partially out of the housing.

15. The portable hoist assembly of claim 14 further comprising wherein when the actuating member is activated the cable is pulled into the housing.

* * * * *